United States Patent [19]

Fauvel

[11] 4,256,178

[45] Mar. 17, 1981

[54] COAXIAL HEAT EXCHANGER AND METHOD FOR CONSTRUCTING A HEAT EXCHANGER

[75] Inventor: Günter Fauvel, Unterföhring, Fed. Rep. of Germany

[73] Assignee: Maschinenfabrik Augsburg-Nurnberg Aktiengesellschaft, Fed. Rep. of Germany

[21] Appl. No.: 878,781

[22] Filed: Feb. 17, 1978

[30] Foreign Application Priority Data

Feb. 17, 1977 [DE] Fed. Rep. of Germany ..... 2706715

[51] Int. Cl.[3] ..... F28F 21/04; F28D 7/00; F28F 9/04

[52] U.S. Cl. ..... 165/165; 65/4 A; 165/175; 165/DIG. 8; 264/248

[58] Field of Search ..... 165/165, 164, 174, 175, 165/172, 180, DIG. 8; 264/248, 241; 65/108, 110, 4 A

[56] References Cited

U.S. PATENT DOCUMENTS

| | | | |
|---|---|---|---|
| 3,396,783 | 8/1968 | Siempelkamp | 165/165 |
| 3,414,052 | 12/1968 | Chojnowski et al. | 165/164 |
| 3,419,069 | 12/1968 | Baker et al. | 165/174 |
| 3,435,893 | 4/1969 | Withers | 165/180 |
| 3,627,039 | 12/1971 | Tiefenbacher | 165/165 |
| 3,854,523 | 12/1974 | Smith et al. | 165/DIG. 8 |
| 3,926,251 | 12/1975 | Pei | 165/165 |
| 4,049,049 | 9/1977 | Mold et al. | 165/165 |

FOREIGN PATENT DOCUMENTS

| | | | |
|---|---|---|---|
| 2721321 | 2/1978 | Fed. Rep. of Germany | 165/165 |

*Primary Examiner*—Sheldon Richter
*Attorney, Agent, or Firm*—Craig and Antonelli

[57] ABSTRACT

A heat exchanger and process for constructing the heat exchanger with the heat exchanger including a plurality of tubes which are to be traversed by two fluid media to be heat exchanged with each other with each tube having a tube end for the entrance of the respective fluid medium and a tube end for the exit of the respective fluid medium. The tubes are juxtaposed so that at each end of the heat exchanger, the tube ends of the tubes to be traversed by one fluid medium project in an axial direction beyond the other tube ends of the remaining tubes located at this end of the heat exchanger. The tube ends of the tubes to be traversed by one of the fluid media which project beyond the other tube ends of the remaining tubes are combined into a bundle at each end of the heat exchanger. At least some of the components of the heat exchanger are shaped from a deformable starting material containing one of two starting compounds of a ceramic substance with the starting compound contained in the starting material being caused to react with the other starting compound so as to convert the starting material of the components into a ceramic substance.

24 Claims, 12 Drawing Figures

COAXIAL HEAT EXCHANGER AND METHOD FOR CONSTRUCTING A HEAT EXCHANGER

The present invention relates to a heat exchanger and a method for constructing a heat exchanger, the heat exchanger including a plurality of tubes, juxtaposed for purposes of heat exchange, which tubes are traversed by two fluid media between which the heat exchange is to be effected with each tube having a tube end for entrance of the respective fluid medium and a tube end for the exit of the respective fluid medium.

Heat exchangers of the afore-mentioned type must frequently meet the requirements of having a high heat exchange capacity and yet small external dimensions. However, a high heat exchange capacity with small external dimensions can only be attained under increased technical expenditure in the construction and manufacture of the heat exchanger.

Consequently, the aim underlying the present invention essentially resides in providing a heat exchanger having a plurality of juxtaposed tubes traversed by two fluid media, which exchanger is compact and simple and which has a high exchange capacity.

According to one feature of the present invention, at each end of the heat exchanger, tube ends of the tubes traversed by one of the fluid media are combined into a bundle and project, in an axial direction, beyond other tube ends of the remaining tubes located at this end.

In accordance with further features of the present invention, the tube ends combined into a bundle at each end of the heat exchanger extend respectively into a first connecting pipe, and the tube ends of the remaining tubes located at each end of the heat exchanger adjoin, respectively, an annular gap formed by a respective first connecting pipe and a second connecting pipe having a larger diameter. The second connecting pipe is fixed in position by a spacer element which may be constructed as a separate component or may be formed integrally with one of the two connecting pipes and be coaxially disposed with respect to the first connecting pipe.

If the tube ends combined into a bundle at one end of the heat exchanger and the other tube ends located at the other end pertain to tubes being traversed by a first one of the two fluid media and if the tube ends combined into a bundle at the other end of the heat exchanger and the tube ends located at the one end of the heat exchanger pertain to the second one of the two fluid media, then the sequence of the fluid media is reversed in the radial direction between the two ends of the heat exchanger. Due to the coaxial feeding and discharging of the fluid media, for reasons of safety and/or for mimimizing heat losses, the sequence of the fluid media in the radial direction at the hot end of the heat exchanger should be chosen so that the hotter fluid medium is insulated from the colder fluid medium with respect to the surroundings.

If the tube ends combined into a bundle at one end of the heat exchanger and the tube ends combined into a bundle at the other end of the heat exchanger pertain to the tubes traversed by a first one of the two fluid media and if the other tube ends located at one end and at the other end of the heat exchanger pertain to the remaining tubes traversed by the second one of the two fluid media, then the sequence of the fluid media in the radial direction at one end of the heat exchanger coincides with that at the other end of the heat exchanger. On the basis of the coaxial feed and discharge of the fluid media, it is possible to select, at both ends of the heat exchanger, the arrangement of fluid media which is in the interest of safety.

According to the present invention, only one collecting chamber is provided for each fluid medium, through which collecting chamber extend the tubes carrying the other fluid medium such that a compact arrangement results and the collecting chambers participate in the heat exchange. Furthermore, the tubes in the zone of the collecting chamber effect a turbulence of the fluid media flowing out of and/or into an annular gap of the connecting pipes.

According to still further features of the present invention, the tube ends combined into a bundle with each end of the heat exchanger are surrounded by a tubular internal shell inserted in the respective first connecting pipe. The tubular internal shells serve for holding the bundled pipe ends together and as a connecting means for the first connecting pipes.

According to an additional feature of the present invention, the second connecting pipes are surrounded by an external shell of a tubular configuration extending between the two ends of the heat exchanger with the external shells serving for insulating the tubes traversed by the two fluid media with respect to the surroundings.

In accordance with another feature of the present invention, at least some of the components of the heat exchanger consist of a ceramic material. In contrast to conventional heat exchangers made of ceramic material, the heat exchanger of the present invention does not require any additional connecting means and connecting techniques between the individual ceramic parts which heretofore represented, in ceramic heat exchangers, an extremely serious problem with respect to the manufacturing of the heat exchanger and additionally posed considerable sealing problems.

According to yet another feature of the present invention, a process is disclosed for the manufacture of a heat exchanger which includes a plurality of tubes which are to be traversed by two fluid media to be heat exchanged with each other, each tube having a tube end for the entrance of the respective fluid medium and a tube end for the exit of the respective fluid medium with the process being characterized in that the tubes are juxtaposed so that, at each end of the heat exchanger, the tube ends of the tubes to be traversed by one fluid medium project in an axial direction beyond the other tube ends of the remaining tubes located at this end of the heat exchanger and, at each end of the heat exchanger, the tube ends of the tubes to be traversed by one of the fluid media which project beyond the other tube ends of the remaining tubes are combined into a bundle.

According to the present invention, the tubes are compressed by a radial pressure so as to increase the compactness of the heat exchanger and also to force the wall cavities of the tubes against each other so that any cavities or spaces between the tubes are eliminated.

In accordance with a further feature of the present invention, one tubular internal shell is arranged on each tube end bundle so that the tube end bundles are held together.

In accordance with the present invention, one first connecting pipe is respectively arranged on each tubular internal shell with a second connecting pipe being fixed in position with respect to the first connecting pipe by separate or integrally formed spacer elements with the second connecting pipe being joined to the other tube ends of the remaining tubes and with an external shell being provided on the two connecting pipes and between a region of the first connecting pipe located between the two second connecting pipes.

In accordance with yet another feature of the present invention, at least some of the components of the heat exchanger are first of all shaped from a deformable starting material containing one of two starting compounds of a ceramic substance. Thereafter, the starting compound contained in the starting material is caused to react with the other starting compound so that the starting material of the components is converted into the ceramic substance. In this connection, it is to be pointed out that the formation of the ceramic material can also be conducted in stages.

With the use of a readily moldable starting material for the ceramic substance, it is possible to impart to the heat exchanger configurations and dimensions impossible to attain by means of conventional methods for the construction of ceramic heat exchangers.

Due to the easy moldability and elasticity of carbon fibers, according to the present invention, it is advantageous to produce the tubes and other components of the heat exchanger from carbon fibers and to introduce, after the shaping of the tubes, either liquid or gaseous silicon or a liquid or gaseous silicon compound into the carbon fiber tubes and into the components and to subsequently heat the thus prepared tubes and components so that the carbon bound in the carbon fibers forms silicon carbide with the silicon or the silicon compound.

After installing the internal shells and the outer shell, another feature of the present invention provides for the subjecting of the tubes to a heat treatment before the carbon fibers are brought into contact with the gaseous or liquid silicon or with the gaseous or liquid silicon compound. By this heat treatment taking place at suitable temperatures, pressures and over a sufficiently long period of time, there results compensation for the stresses mechanically arising in the cold state and thermally imparted during heating on account of thermal expansion due to the elasticity of the material present under these conditions.

According to the present invention, silicon or a silicon compound is embedded in the form of particles into the carbon fibers so that the silicon has only a minor freedom of motion within the carbon fiber tubes, whereby the density of the ceramic material is increased.

To attain a high density and a satisfactory connection among the components of the heat exchanger, it is advantageous, according to the present invention, to introduce, prior to the pressing or compressing step, a filling material of at least one of the two starting compounds in the form of particles or cores into spaces between the tubes.

Advantageously, according to the present invention, the internal shells and/or external shell and/or the first and second connecting pipes are formed of carbon fibers and are wound with the strength of these components being increased if the pitch and/or direction of the wound layers is correspondingly chosen.

Another manner of constructing the ceramic heat exchanger in accordance with the present invention resides in introducing the starting material of the tubes into at least one annular gap formed by at least two coaxially guided, flexible tubes consisting of a material containing the other starting compound of the ceramic substance and in providing that, during the reaction of the two starting compounds, the tubes forming the annular gap are volatized, whereby one tube or several tubes of ceramic material will remain. It is possible according to the present invention to utilize a plurality of annular gaps or an endless annular gap which is subsequently sub-divided into sections.

Accordingly, it is an object of the present invention to provide a heat exchanger and method of making a heat exchanger which avoid by simple means shortcomings and disadvantages encountered in the prior art.

Another object of the present invention resides in providing a heat exchanger which is very compact and has extremely advantageous strength, flow and heat exchange properties.

Yet another object of the present invention resides in providing a heat exchanger which permits a co-current as well as counter-current operation.

An additional object of the present invention resides in providing a heat exchanger in which only one collecting chamber per fluid medium is provided through which extend the tubes carrying the other fluid medium, thereby resulting in a compact arrangement.

A further object of the present invention resides in providing a heat exchanger which functions reliably under all operating conditions.

A still further object of the present invention resides in providing a heat exchanger employing a honeycomb-shaped exchange structure of extremely high density.

Yet an additional object of the present invention resides in providing a heat exchanger of a ceramic construction which may be employed in operating temperatures above 1,000° C.

These and other objects, features and advantages of the present invention will become more apparent from the following description when taken in connection with the accompanying drawings which show, for the purposes of illustration only, several embodiments in accordance with the present invention, and wherein.

Figure 1:
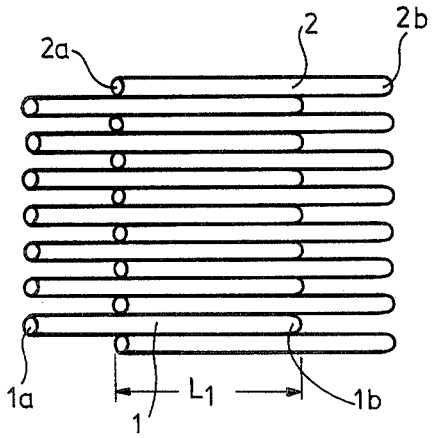
FIG. 1 is a side view of an arrangement of carbon fiber tubes of a heat exchanger constructed in accordance with the present invention with projecting ends of the carbon fiber tubes being in an unbundled condition.
Figure 3:
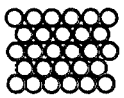
FIG. 3 is a cross-sectional view through a first arrangement of carbon fiber tubes.

Referring now to the drawings wherein like reference numerals are used throughout the various views to designate like parts and, more particularly to FIG. 1, according to this figure, a plurality of equally long elastic carbon fiber tubes 1, 2 of minimum diameter, representing a starting material for a heat exchanger, are provided with the tubes 1, 2 being arranged so that the tubes 1, 2 are parallel and the ends 1*a* of the tubes 1 project in an axial direction beyond ends 2*a* of adjacent tubes 2, and the ends 2*b* of the tubes 2 projecting beyond ends 1*b* of the adjacent tubes 1. The so arranged tubes 1, 2 are superimposed in layers so that a pattern such as shown most clearly in FIG. 3 is obtained.

Figure 5:
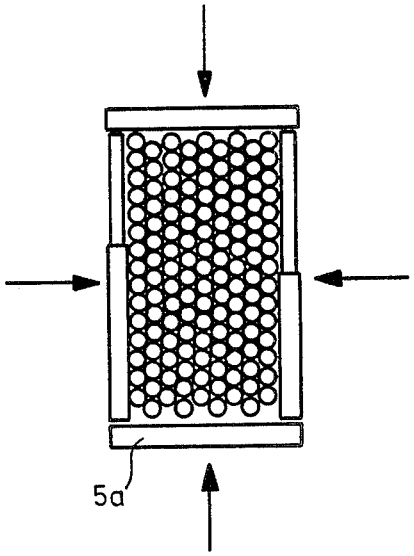
FIG. 5 is a cross-sectional view through a rectangular packing or pressing device for the carbon fiber tubes of the heat exchanger in accordance with the present invention.
Figure 8:
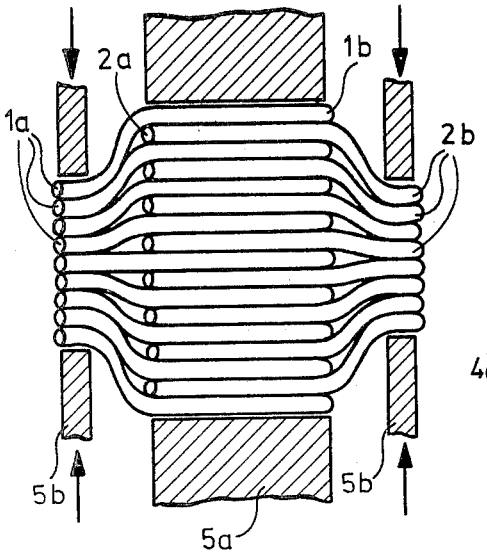
FIG. 8 is a longitudinal cross-sectional view through packing or pressing devices in which the carbon fiber tubes of FIG. 1 are disposed.

To accomplish the arrangement and stacking of the carbon fiber tubes 1, 2, as shown in FIG. 5, the tubes 1, 2 are disposed in a pressing or packing device 5*a*. After the tubes 1, 2 have been stacked, as shown in FIG. 8, the ends 1*a* of the tubes 1 and the ends 2*b* of the tubes 2 are pressed together by a pressing or packing device 5*b* to form a tube bundle at each end of the heat exchanger.

Figure 10:
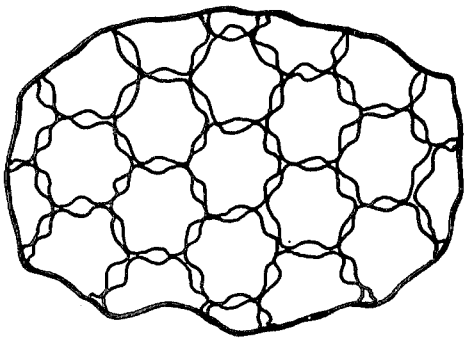
FIG. 10 is a cross-sectional view through several carbon fiber tubes after a pressing or compression step has been executed.

A tube zone $L_1$ (FIG. 1) disposed between the ends 1*a*, 2*b* is likewise compressed radially inwardly by the pressing or packing device 5*a* so that a structure is produced over the zone $L_1$ as well as the ends of the tube pack, as is illustrated most clearly in FIG. 10.

Figure 11:
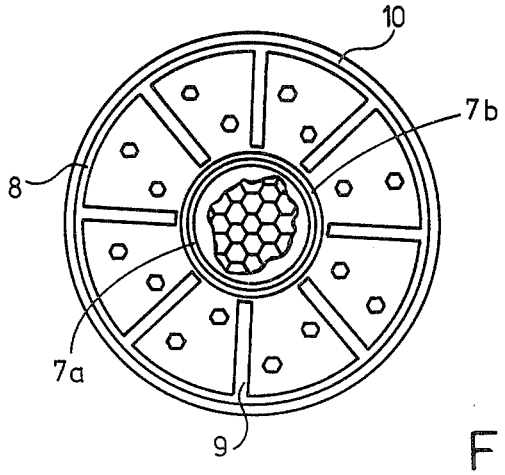
FIG. 11 is an end view of a complete heat exchanger according to the present invention with integral spacer elements.
Figure 12:
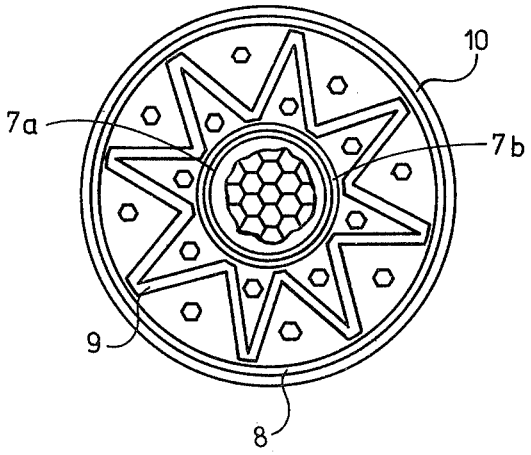
FIG. 12 is an end view of another complete heat exchanger in accordance with the present invention with separate spacer elements.

At this point in time, the thus compressed ends 1*a*, 2*b* are fixed in position by placing a first carbon fiber tube 7*a* (FIG. 11) of an appropriate diameter over the ends 1*a* and a second carbon fiber tube 7*a* of an appropriate diameter over the ends 2*b*. Another manner of applying the tubes 7*a* to the compressed ends 1*a*, 2*b* resides in winding carbon fibers on the compressed ends 1*a*, 2*b*. Each carbon fiber tube 7*a* serves for holding the bundled tube ends together and as a connection for a respective first connecting pipe 7*b* (FIG. 11) coaxially guided in a second connecting pipe 8. The connecting pipes 7*b* are pushed onto the carbon fiber tubes 7*a* and one of the connecting pipes 8 is placed over the pipe ends 2*a*, and the other connecting pipe 8 is placed over the pipe ends 1*b*. One spacer element 9 is arranged between the respective connecting pipes 7*b*, 8 for holding the connecting pipes 7*b* and 8 in position. The spacer element 9, as shown in FIG. 11, consists of a plurality of radially extending ribs disposed at spacings at the inner wall surface of the second connecting pipe 8 and being integral therewith. The ribs may be supported with their radially inner ends on the outer wall surface of the first connecting pipe 7*b*. Alternatively, as shown in FIG. 12, the spacer element 9′ may be constructed as a stellate structure separate from the two connecting pipes 7*b*, 8.

Each spacer element 9 may also be separated, respectively, from one of the two connecting pipes 7*b* and 8 by a gap so as to compensate for a change in the diameter of the tubes 1, 2 due to thermal expansion.

The tube pack is then provided with a winding so that the connecting pipes 8 and the tube zone disposed therebetween are surrounded by a homogeneous wall 10.

This unfinished heat exchanger is now subjected to a heat treatment so as to compensate for the compressive stresses imparted in the cold condition mechanically by the packing or pressing device 5*a*, 5*b* and thermally during heating by thermal expansion. Due to a heat treatment, a more or less regular hexagonal honeycomb structure of an extremely high area density is created, as shown most clearly in FIGS. 11 or 12.

Finally, the carbon fiber components of the unfinished heat exchanger are impregnated with gaseous or liquid silicon or with a gaseous or liquid silicon compound and made to react at about 1750 K. During this step, the silicon or silicon compound forms silicon carbide with the carbon bound in each of the carbon fibers, which silicon carbide pertains to the group of ceramic materials.

This ceramic heat exchanger which, due to its external shape, is called a "bottle recuperator", is utilized with a co-current as well as a counter-current flow of the fluid media. The two fluid media are fed and discharged coaxially through the connecting pipes 7*b* and 8 with the heat exchange taking place within the tubes 1, 2 as well as in each of two collecting chambers disposed between the outer connecting pipes 8 and the projecting pipe ends 1*a*, 2*b*. The hotter fluid medium is fed to the heat exchanger by way of the internal connecting pipe 7*b* and is insulated with respect to the surroundings by the colder fluid medium conducted in the annular gap. In this connection, it should also be pointed out that the heat exchanger, according to the first embodiment of the invention, reverses the sequence of the flow media in a radial direction.

Furthermore, it is also possible to realize a heat exchange in a cross-current of the two fluid media in the collecting chambers, depending on the shape of the spacer elements.

Differing flow cross-sections for the two fluid media can be obtained either by providing, for one of the fluid media, a larger number of tubes, or by using tubes of a larger diameter. The compactness of the heat exchanger is greater as the diameter and wall thickness of the initial tubes 1, 2 are made of a smaller construction.

With respect to the strength factor, the heat exchanger of the present invention, on the one hand, has an inherent stability of the honeycomb structure and, on the other hand, the basic fiber structure has an advantageous influence, even after the SiC reaction.

During the manufacture of the heat exchanger, care must be taken that the tubes 1, 2, especially at their ends 1*a*, 2*b*, are compressed in such a way and/or are deformed during the heat treatment so that, during the SiC formation process, the individual tubes merge firmly and, above all, absolutely tightly with one another. It is important that the spaces between the tubes are completely sealed, so that the fluid media conducted in the respective connecting pipes 7*b*, 8 is forced into the interior of the respective tubes.

In another version of a heat exchanger having tubes 1, 2 arranged in the manner of FIG. 1, the carbon fiber tubes 7*a* and the connecting pipe 7*b* may be constructed identically.

The spacer element may also include a plurality of radial ribs arranged at spacings with respect to one another along the outer wall surface of the connecting pipe 7*b*, with the radial ribs being firmly joined to the connecting pipe 7*b*.

Figure 2:
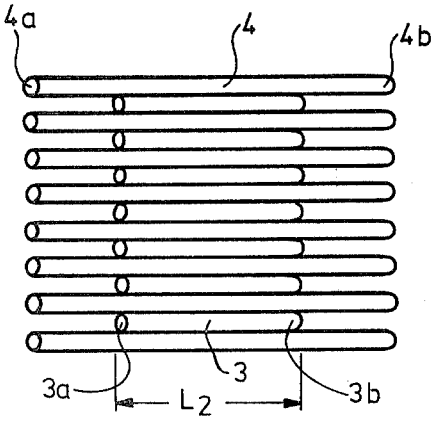
FIG. 2 is a side view of a further arrangement of carbon fiber tubes for a heat exchanger constructed in accordance with the present invention with projecting ends of the carbon fiber tubes being in an unbundled condition.
Figure 9:
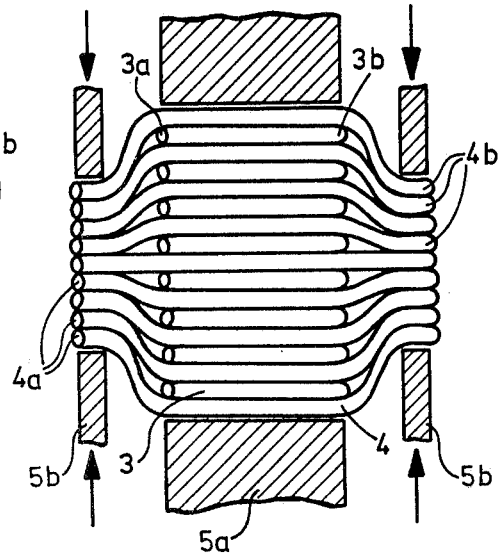
FIG. 9 is a longitudinal cross-sectional view through packing or pressing devices in which the carbon fiber tubes of FIG. 2 are disposed.

In the arrangement of FIGS. 2 and 9, the disposition and length of the carbon fiber tubes 3, 4 differ from the disposition and length of the carbon fiber tubes 1, 2 of the construction of FIG. 1. Specifically, the carbon fiber tubes 4 are of a longer length than the tubes 3 and project in an axial direction at both ends of the heat exchanger beyond ends 3*a*, 3*b* of the tubes 3. In a similar manner as in the construction of FIG. 1, the tubes 3, 4 are stacked in layers according to, for example, the pattern shown in FIG. 3, and the projecting tube ends 4*a*, 4*b* are bundled by way of pressing or packing devices 5*b* (FIG. 9). Additionally, in the zone $L_2$, the tubes 3, 4 are compressed with the aid of the pressing or packing device 5*a* (FIG. 9). The further construction of the heat exchanger is effected as in the first embodiment of the present invention and, consequently, will not be explained in further detail.

With the heat exchanger of FIG. 2, the sequence of the fluid media in the radial direction at one end of the heat exchanger coincides, of course, with the other end of the heat exchanger and the heat exchanger can be operated in a co-current and in a counter-current fashion. If the spacer elements are of an appropriate structure, it is also possible to effect a cross-current operation in the collecting chambers.

It is also possible in accordance with the present invention to omit the use of the short tubes 3 and, in lieu of the tubes 3, provide cavities which are defined in or by the tube walls of the tubes 4.

Figure 4:
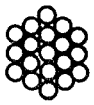
FIG. 4 is a cross-sectional view through a second arrangement of carbon fiber tubes.
Figure 6:
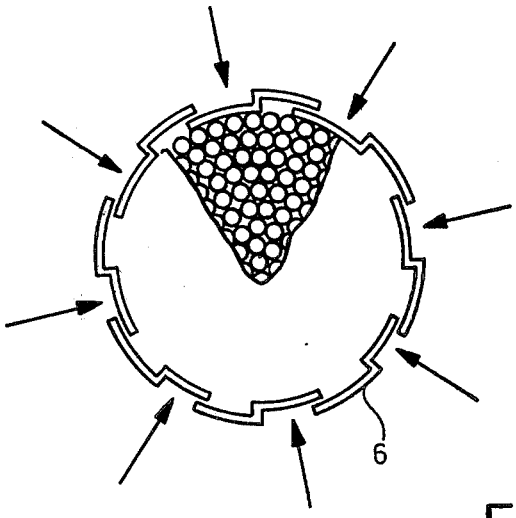
FIG. 6 is a cross-sectional view through a circular packing or pressing device for the carbon fiber tubes of the heat exchanger in accordance with the present invention.

The tubes 1, 2 or 3, 4 of the heat exchangers according to the present invention can also be stacked in layers so as to obtain a pattern such as shown in FIG. 4. In stacking the tubes 1, 2 or 3, 4 in such a pattern, one circular packing or pressing device 6 such as shown, for example, in FIG. 6 or FIG. 7, may be employed for bundling the projecting tube ends 1*a*, 2*b* or 3*a*, 4*b* and for compressing the tube sections or zones $L_1$, $L_2$, respectively, lying between the projecting ends of the tubes 1, 2 or 3, 4.

Figure 7:
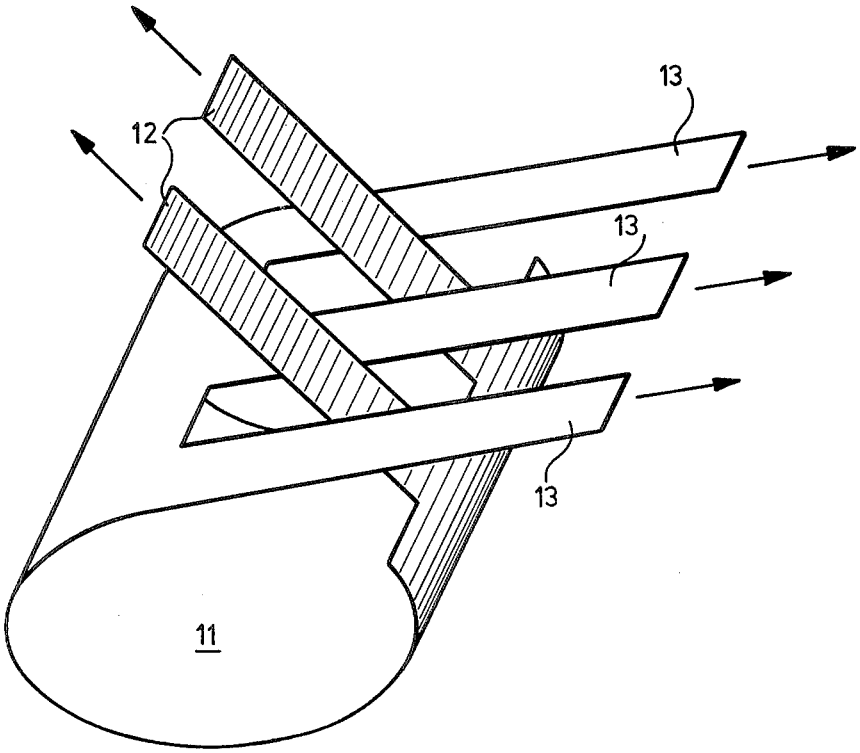
FIG. 7 is a perspective view of an alternative circular packing or pressing device for the carbon fiber tubes of the heat exchanger constructed in accordance with the present invention.

As shown in FIG. 7, the packing or pressing device 6 may be formed of a rectangular carbon fiber ribbon 11 having at one end two parallel tongues 12 and at the other end three parallel tongues 13. The carbon fiber ribbon 11 is wound around the carbon fiber tubes 1, 2 or 3, 4 so that the tongues 12 engage in the cutouts provided between the tongues 13. Thereafter, a traction force is exerted on the tongues 12 in one direction and a traction force is exerted on the tongues 13 in the other direction so that a radial pressure is applied to the tubes 1, 2 or 3, 4 disposed within the carbon fiber ribbon 11. The thus tensioned carbon fiber ribbon 11 then remains on the tube pack and can be fixed in position by another layer of carbon fibers wound thereon. As apparent, the carbon fiber ribbon 11 can be constructed with more or less tongues 12, 13 depending, for example, on the size of the tube bundle.

The ceramic heat exchanger according to the first and second embodiments of the present invention can also be utilized at operating temperatures above 1,000° C. Heretofore, the specific manufacturing techniques used in connection with ceramics precluded compact recuperative heat exchange systems of a high area density. Also, the use of honeycomb-shaped exchange structures of an extremely high area density in co-current and/or counter-current recuperators has heretofore been impossible since the fluid media could not be distributed among the miniature flow channels.

The heat exchangers according to the present invention may, for example, be constructed as U-tube or helical-tube recuperators provided with internal ribs. Furthermore, the outer shell of the heat exchanger could be cooled by an additional flow medium flowing around the heat exchanger.

While I have shown and described several embodiments in accordance with the present invention, it is understood that the same is not limited thereto, but is susceptible of numerous changes and modifications as known to those skilled in the art to which it pertains, and I therefor do not wish to be restricted to the details shown and described hereinabove, but intend to cover all such changes and modifications as are encompassed by the scope of the appended claims.

I claim:

1. A heat exchanger which includes a plurality of juxtaposed parallel tubes for the purpose of effecting a heat exchanger when the tubes are traversed by two fluid media between which the heat exchange is to be effected, each tube having a tube end for an entrance of a respective fluid medium and a tube end for an exit of a respective fluid medium, characterized in that at each end of the heat exchanger the tube ends of the tubes to be traversed by one of the fluid media project in an axial direction beyond the tube ends of the other remaining tubes at that end of the heat exchanger and are combined into a bundle in the manner of a bottleneck wherein the tube ends of the bundle contact one another.

2. A heat exchanger according to claim 1, characterized in that at least a portion of the heat exchanger is constructed of a ceramic material.

3. A heat exchanger according to claim 1, characterized in that at least a portion of the heat exchanger is constructed of a ceramic material.

4. A heat exchanger according to claim 1, characterized in that said plurality of juxtaposed tubes includes two sets of tubes with the tubes of one set to be traversed by a first fluid medium of said two fluid media and the tubes of the second set to be traversed by the second fluid medium of said two fluid media, and wherein the one ends of the tubes of said first set project beyond the one ends of the tubes of said second set at one end of said heat exchanger and the other ends of the tubes of the second set project beyond the other ends of the tubes of the first set at the other end of said heat exchanger, the projecting ends of the tubes of both sets being respectively combined into a bundle in the manner of a bottleneck wherein the tube ends of the bundle contact one another.

5. A heat exchanger according to claim 1, characterized in that said plurality of juxtaposed tubes includes two sets of tubes with the tubes of one set to be traversed by a first fluid medium of said two fluid media and the tubes of the second set to be traversed by the second fluid medium of said two fluid media, and wherein the one ends of the tubes of said first set project beyond the one ends of the tubes of said second set at one end of said heat exchanger and the other ends of the tubes of the first set project beyond the other ends of the tubes of the second set at the other end of said heat exchanger, the projecting ends of the tubes of the first set being respectively combined into a bundle in the manner of a bottleneck wherein the tube ends of the bundle contact one another.

6. A heat exchanger according to claim 1, characterized in that a first connecting pipe is provided at each end of the heat exchanger, the tube ends combined into a bundle at each end of the heat exchanger respectively extend into the first connecting pipe, and in that the tube ends of the remaining tubes located at each end of the heat exchanger adjoin, in each case, an annular gap formed by the respective first connecting pipe and a second connecting pipe of a larger diameter, the second connecting pipe is fixed in position with respect to the first connecting pipe by a spacer element, the spacer element extends coaxially with respect to the first connecting pipes and is constructed so as to be one of separate or integral with one of the first or second connecting pipes.

7. A heat exchanger according to claim 6, characterized in that at least a portion of the heat exchanger is constructed of a ceramic material.

8. A heat exchanger according to claim 6, characterized in that a tubular internal shell is inserted in the respective first connecting pipe with the tube ends combined into a bundle at each end of the heat exchanger being surrounded by the tubular internal shell.

9. A heat exchanger according to claim 8, characterized in that a tubular external shell extends between the two ends of the heat exchanger, and in that the second connecting pipes are surrounded by the tubular external shell.

10. A heat exchanger according to claim 9, characterized in that at least a portion of the heat exchanger is constructed of a ceramic material.

11. A heat exchanger according to claim 6, characterized in that a tubular external shell extends between the two ends of the heat exchanger, and in that the second connecting pipes are surrounded by the tubular external shell.

12. A heat exchanger according to claim 11, characterized in that at least a portion of the heat exchanger is constructed of a ceramic material.

13. A process for the production of a heat exchanger which includes a plurality of parallel tubes which are to be traversed by two fluid media to be heat exchanged with each other, each tube having a tube end for an entrance of a respective fluid medium and a tube end for an exit of a respective fluid medium, characterized by juxtaposing the tubes so that at each end of the heat exchanger the tube ends of the tubes to be traversed by one of the fluid media project in an axial direction beyond tube ends of the other remaining tubes located at that end of the heat exchanger, and at each end of the heat exchanger combining the projecting tube ends into a bundle in the manner of a bottleneck so that the tube ends of the bundle contact one another.

14. A process according to claim 13, characterized in that said plurality of tubes includes two sets of tubes of which the tubes of one set are to be traversed by a first fluid medium of said two fluid media and the tubes of the second set are to be traversed by the second fluid medium of said two fluid media, and wherein said juxtaposing step includes arranging the tubes of said two sets in such a way that the one ends of the tubes of the first set project beyond the one ends of the tubes of the second set at one end of said heat exchanger and the other ends of the tubes of the second set project beyond the other ends of the tubes of the first set at the other end of said heat exchanger, and in said combining step the projecting ends of the tubes of both tube sets are respectively combined into a bundle in the manner of a bottleneck so that the tube ends of the bundle contact one another.

15. A process according to claim 13, characterized in that said plurality of tubes includes two sets of tubes of which the tubes of one set are to be traversed by a first fluid medium of said two fluid media and the tubes of the second set are to be traversed by the second fluid medium of said two fluid media, and wherein said juxtaposing step includes arranging the tubes of said two sets in such a way that the one ends of the tubes of the first set project beyond the one ends of the tubes of the second set at one end of said heat exchanger and the other ends of the tubes of the first set project beyond the other ends of the tubes of the second set at the other end of said heat exchanger, and in said combining step the projecting ends of the tubes of said first set are respectively combined into a bundle in the manner of a bottleneck so that the tube ends of the bundle contact one another.

16. A process according to claim 13, characterized in that the step of combining includes compressing the tubes by a radial pressure.

17. A process according to claim 16, further characterized by applying one tubular internal shell on each tube end bundle.

18. A process according to claim 17, further characterized by applying one first connecting pipe on each tubular internal shell, applying a second connecting pipe of a larger diameter to the other tube ends at the respective ends of the heat exchanger, fixing the second connecting pipe with respect to the first connecting pipe by a spacer element which is one of separate or integral with one of the first and second connecting pipes, and applying an external shell to the two second connecting pipes and to a tube zone disposed between the two second connecting pipes.

19. A process according to claim 18, further characterized by shaping at least some components of the heat exchanger from a moldable starting material containing one of two starting compounds of a ceramic substance, and causing a reaction of the starting compound contained in the starting material with the other starting compound so that the starting material of the at least some components of the heat exchanger is converted into a ceramic substance.

20. A process according to claim 19, further characterized by introducing the starting material into at least one annular gap formed by at least two coaxially guided flexible tubes consisting of a material containing the other starting compound of the ceramic substance, and volatizing the tubes forming the annular gap during a reaction of the two starting compounds such that there remains at least one tube of a ceramic material.

21. A process according to claim 19, further characterized by producing tubes and remaining components of the heat exchanger from carbon fibers, introducing one of a liquid or gaseous silicon or a liquid or gaseous silicon compound into the carbon fiber tubes and into the remaining components of the heat exchanger, and heating the thus prepared tubes and remaining components so that a carbon bound in the carbon fibers forms silicon carbide with one of the silicon and silicon compound.

22. A process according to claim 21, further characterized by subjecting the tubes to a heat treatment prior to bringing the carbon fibers of the tubes into contact with the one of the gaseous or liquid silicon or gaseous or liquid silicon compound.

23. A process according to claim 22, further characterized by introducing a filler material of at least one of the two starting compounds in the form of one of particles and cores into spaces between the tubes prior to the compressing of the tubes by radial pressure.

24. A process according to claim 23, characterized in that at least one of the steps of applying the internal shells, the external shell, and the first and second connecting pipes includes winding carbon fibers to form the internal shells, external shell or the first and second connecting pipes.

* * * * *